US006871438B2

(12) United States Patent
Lawless

(10) Patent No.: US 6,871,438 B2
(45) Date of Patent: Mar. 29, 2005

(54) DEVICE FOR RENDERING A FIREARM SAFE FOR DRY FIRE PRACTICE

(75) Inventor: Albert J. Lawless, Boulder, CO (US)

(73) Assignee: J & L Research LLC, Boulder, CO (US)

( * ) Notice: Subject to any disclaimer, the term of this patent is extended or adjusted under 35 U.S.C. 154(b) by 0 days.

(21) Appl. No.: 10/410,171

(22) Filed: Apr. 10, 2003

(65) Prior Publication Data

US 2004/0200113 A1 Oct. 14, 2004

(51) Int. Cl.[7] ..... F41A 17/30
(52) U.S. Cl. ..... 42/70.11; 42/70.01; 42/70.08
(58) Field of Search ..... 42/70.01, 70.08, 42/70.11

(56) References Cited

U.S. PATENT DOCUMENTS

| | | | | | |
|---|---|---|---|---|---|
| 2,327,334 | A | * | 8/1943 | Parker | 42/70.11 |
| 2,763,081 | A | * | 9/1956 | Huckabee | 42/70.11 |
| 3,027,674 | A | * | 4/1962 | Mahan | 42/66 |
| 3,137,957 | A | * | 6/1964 | Ingalls | 42/70.11 |
| 3,193,959 | A | * | 7/1965 | Jaycox | 42/70.11 |
| 3,708,901 | A | * | 1/1973 | Wolter | 42/70.11 |
| 4,023,294 | A | * | 5/1977 | Knopp | 42/70.11 |
| 4,835,894 | A | | 6/1989 | Libassi | 42/70.11 |
| 4,969,284 | A | * | 11/1990 | Healey et al. | 42/70.11 |
| 5,038,508 | A | * | 8/1991 | Brown | 42/70.11 |
| 5,052,142 | A | * | 10/1991 | Mikus | 42/70.11 |
| 5,097,613 | A | | 3/1992 | Miller et al. | 42/70.01 |
| 5,233,777 | A | * | 8/1993 | Waterman et al. | 42/70.11 |
| 5,357,704 | A | * | 10/1994 | Benkovic | 42/70.11 |
| 5,435,090 | A | | 7/1995 | Darrow | 42/95 |
| 6,170,186 | B1 | * | 1/2001 | Reed | 42/70.11 |
| 6,226,914 | B1 | * | 5/2001 | Reed | 42/70.11 |
| 6,393,750 | B1 | * | 5/2002 | Rossini et al. | 42/70.11 |
| 6,442,881 | B1 | * | 9/2002 | Kellerman | 42/70.11 |
| 6,470,615 | B1 | | 10/2002 | Peterken | 42/70.01 |
| 6,543,171 | B2 | * | 4/2003 | Kellerman | 42/70.11 |
| 6,578,308 | B2 | * | 6/2003 | Hickerson | 42/70.11 |
| 6,604,313 | B1 | * | 8/2003 | Kress | 42/70.11 |

FOREIGN PATENT DOCUMENTS

GB 2233075 A * 1/1991

OTHER PUBLICATIONS

American Heartland USA, Inc., "Ammo–Safe", http://www.americanheartland.com/ammo–safe.htm, 3 pages.
Police and Security News, Days Communication, Inc., Jan./Feb. 2003, 1 page.

* cited by examiner

*Primary Examiner*—Jack Kern
*Assistant Examiner*—John Richardson
(74) *Attorney, Agent, or Firm*—Connolly, Bove, Lodge & Hutz LLP

(57) ABSTRACT

The firearm device for disabling a firearm for dry fire practice. A bushing is inserted in the firearm having a diameter of a cartridge. The bushing includes a through bore which receives a length of flexible material. One end of the flexible material is enlarged, so that is stops when it is pulled against the surface of the bushing. The length of flexible material extends through the barrel and is visible to users of the device. The length of the bushing and enlarged end of the flexible material is established so that the rear surface of the enlarged end is positioned to be struck by the firearm firing pin when the hammer is released. The device prevent and round from accidentally being introduced into the chamber, as well as indicates to users that the device has been safely rendered inoperative for dry fire practice.

9 Claims, 1 Drawing Sheet

DEVICE FOR RENDERING A FIREARM SAFE FOR DRY FIRE PRACTICE

BACKGROUND OF THE INVENTION

The present invention relates to safety devices for firearms. Specifically, a device is disclosed which can be inserted in a firearm and permit the firearm to be used in dry fire practice which avoids an accidental discharge, as well as protects the firearm from damaging the firing pin.

The training of persons to safely use firearms in confrontational situations requires actual firing time on a firing range, as well as exercises wherein unloaded firearms are used to demonstrate various defensive actions. Range officers who conduct such training must carefully scrutinize each trainee's performance, so as to make certain the trainee learns the safe handling of loaded firearms. These exercises typically involve live firing of the firearm under close supervision.

In other exercises carried out by the trainee, the firearm is operated in an unloaded condition, and dry fired, i.e., fired without ammunition. A significant source of fatal accidents results from accidental discharges, which occur when training switches from a live fire session to a dry fire practice session. The problem of making certain that all firearms are properly unloaded during dry fire practice is exasperated by the fact that an empty firearm with a closed chamber is usually indistinguishable from one in which a cartridge has been loaded and is ready to fire. For this reason, accidental discharges occur at an unfortunately alarming rate.

Various devices have been proposed in the past for disabling the firearm. These devices typically fit within the firing chamber, and obstruct any introduction of a round into the firing chamber. Examples of such devices can be found in U.S. Pat. Nos. 4,835,894; 5,097,613; 5,435,090; and 6,470,615.

Associated with the problem of making sure that a live round is not introduced into the chamber during dry fire practice, is a problem of determining from casual observation whether or not firearm has been disabled. Since the slide is closed and the bolt is in battery position during dry fire practice, viewing of the disabled device does not disclose whether or not it is in fact disabled and perhaps carries a live round.

The present invention improves upon the foregoing devices in providing an easily inserted obstruction in the firing chamber which prevents a round from being chambered, as well as indicates to the user that a firearm may be safely used for dry fire practice.

SUMMARY OF THE INVENTION

A firearm safety device is provided which makes use of an article of manufacture to render a firearm safe for dry fire practice. A bushing having a diameter of a cartridge is placed in a chamber of a firearm and has a bore for receiving a length of flexible material. When the bushing is inserted in the chamber of the firearm, the flexible material extends from the bushing bore through the barrel, and is visible at the distal end of the barrel. The bushing includes on a rear surface thereof a pliable surface, which may be the end of the flexible material, which can be struck by a firing pin when the hammer of the firearm is released during dry fire practice. The material has a hardness which avoids damaging firing pin while at the same time inhibiting the introduction of a live round into the chamber.

In accordance with a preferred embodiment of the invention, the flexible material may be a cable tie inserted through the bore of the bushing. The end of the cable tie has a locking head which forms the pliant surface being struck by the firing pin. The bushing length is selected so that the proper head spacing is maintained between the surface of the pliant material and the bolt face carrying the firing pin.

The end of the flexible material extending out the distal end of the barrel serves as a visual indication that the firearm has been disabled. Various colors or luminance material can be added to the flexible material to increase the visibility of the distal end at night, or under other training conditions.

DESCRIPTION OF THE PREFERRED EMBODIMENT

Figure 1:
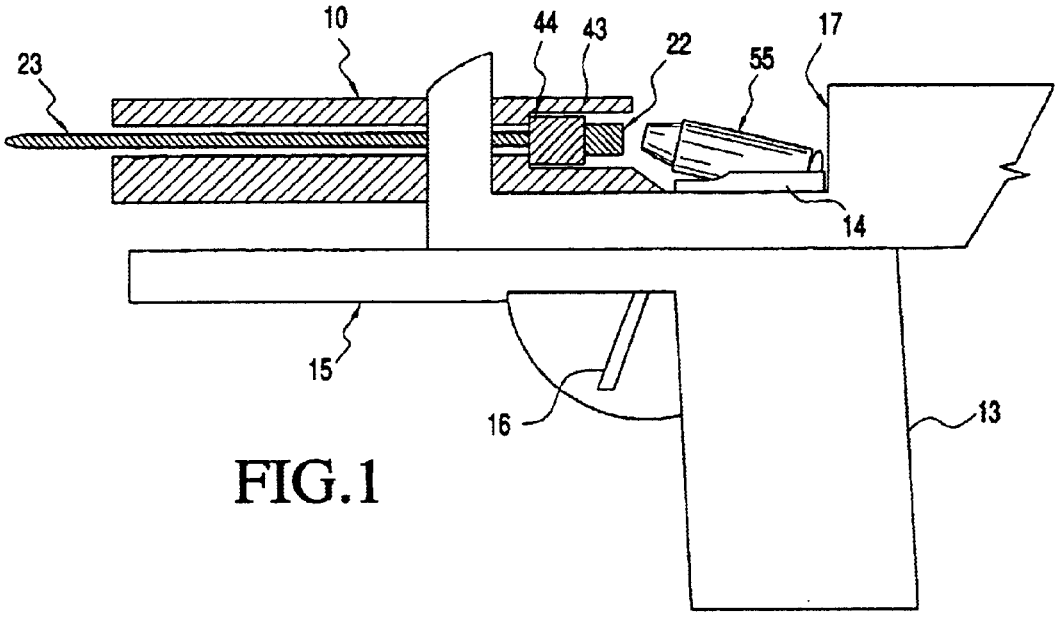
FIG. 1 illustrates a firearm which has been made ready for dry fire practice using a preferred embodiment of the invention.

Referring now to FIG. 1, a partial section view of an auto loading pistol is shown which is made ready for dry fire practice using a preferred embodiment of the invention. The auto loading pistol includes a frame 15 which has a grip portion 13 which receives a magazine 14 for holding cartridges. Magazine 14 presents the top most cartridge or round 55 for chambering within the firearm. During a normal dry fire practice, the magazine 14, if not totally removed, is unloaded and the slide and bolt carrier 17 come forward into a battery position. The closure of the slide and bolt carrier 17 obstructs any view of the chamber, and in normal operation, the condition of the firearm would be unknown, i. e., whether it contained a chambered round ready for firing, or whether the chamber was in fact empty.

The device in accordance with the embodiment of FIG. 1 includes a bushing 44 which is received within the chamber 43 of the firearm. The bushing has an outside diameter, substantially the same as the diameter of a round which is chambered during live fire. Bushing 44 includes a centrally located bore through which extends a flexible material 23, which may be a nylon cable tie. Flexible material 23 extends through the distal end of the barrel 10, and provides a visual indication that the firearm has been disabled for dry fire practice. The flexible material may be colored or provided with other indicia which is readily observable by those in training.

In the event the magazine 14 with a round 55 is inadvertently placed within the auto loaded pistol, the round 55 will not be chambered due to the obstruction presented by bushing 44 and the enlarged end 22 of a cable tie 1.

Assuming that no cartridge 55 is present for chambering, as is expected in a dry fire condition, the slide 17 and bolt come forward into battery position. The length of the bushing 44 is selected so that the rear face of the cable tie locking head 22 is positioned where the primer of a chambered cartridge is positioned.

The material of locking head 22 facing the firing pin is sufficiently pliant so that during a dry fire exercise, the hammer may be released by the trigger 16 to strike the firing pin and drive it into the rear surface of locking head 22. Because of the selected hardness and pliant nature of the rear surface of locking head 22, no damage results to the firing pin.

The flexibility of the cable tie permits its insertion and removal from the firearm in an rapid and safe manner. Further, various lengths of ties may be obtained which permit the device to be used in a different variety of firearms, including rifles, and auto loading pistols, of the same caliber. Thus the device may be readily interchangeable in other types of firearms using the same bushing and substituting inexpensive cable ties of different lengths.

When installing the device, the bushing 44 receives through a centrally located bore the tie 23 which is threaded through the chamber and distal end of the barrel. The locking head 22 of the cable tie is pulled snuggly into place by the cable tie 23 until it abuts the rear surface of bushing 44.

Figure 2:
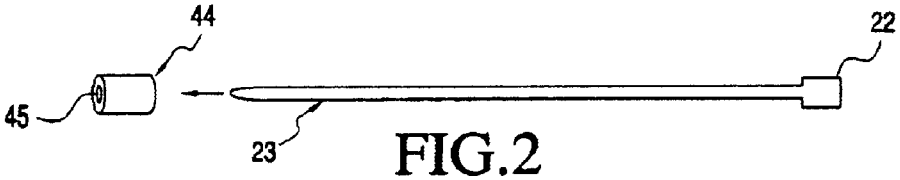
FIG. 2 is an exploded view of a firearm safety device in accordance with a preferred embodiment of the invention.

An exploded view of the preferred embodiment of the invention is illustrated in FIG. 2. Referring now to FIG. 2, the bushing 44 receives distal end 23 of a cable tie, and the cable tie is pulled through the bore 45 of the bushing 44 and barrel 10 stopping when the head 22 strikes the rear surface of bushing 44. As was noted previously, the overall size of the bushing is selected, so that the rear face of the locking head 22 is positioned to received the firing pin when the hammer is released.

Figure 3:
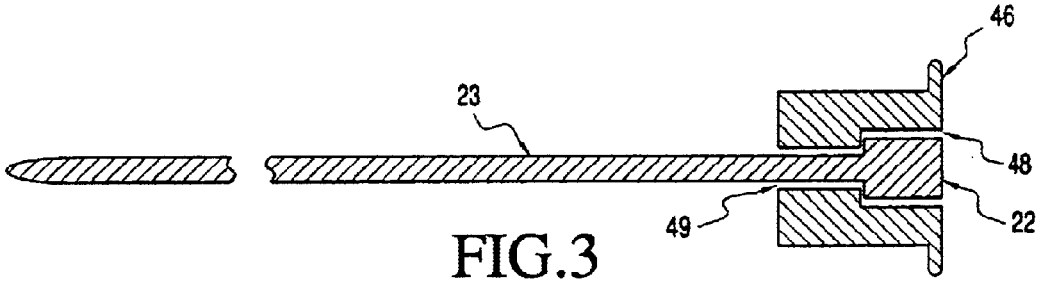
FIG. 3 is a section view of another embodiment of the invention which is suitable for firearms such as shot guns which require a rimmed bushing.
Figure 4:
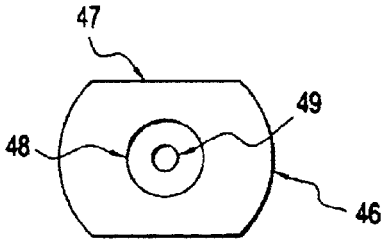
FIG. 4 is an end view of the bushing of FIG. 3.

In some firearms, such as in shot guns, the bushing may need to be configured with a rim corresponding to the rim of a chambered cartridge such as is shown in FIG. 3. Referring now to FIGS. 3 and 4, a section view of a bushing is shown having a rim 46, which maintains the bushing at a location within the chamber. The bushing 49 is counter drilled and the locking head 22 is located in a recess 48, so that the rear surface of the locking head 22 is maintained at the same position as the primer of a cartridge being chambered. The rim portion 47 is removed so that it can be positioned under the extractor, thus preventing the bushing 44 from being removed by cycling the action. The distal end 23 of the tie extends out through the barrel as in the previous embodiment and is visible outside the barrel.

The disclosed device can be rapidly inserted into may different types of firearms, and disable the firearm for dry fire practice while indicating the disabled state to people in training.

The foregoing description of the invention illustrates and describes the present invention. Additionally, the disclosure shows and describes only the preferred embodiments of the invention in the context of a device for rendering a firearm safe for dry fire practice, but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. A firearm safety device comprising:

a bushing having a diameter for entering the chamber of a firearm, said having a through bore; and a length of flexible material having one end enlarged, extending through said bushing and out of the distal end of said firearm barrel, said enlarged end having a surface which is positioned to be stuck by said firearm firing pin when the firearm hammer is released, said flexible material having a hardness which is selected to prevent damage to said firing pin and wherein said flexible material has an end protruding from said distal end to indicate said firearm is safe to dry fire.

2. The firearm safety device according to claim 1 wherein said flexible material is a cable tie with a locking head at one end thereof constituting said enlarged end.

3. The firearm safety device according to claim 1 wherein said bushing has a length to provide a spacing between said one end of said flexible material and said firing pin to permit said material to be struck by said firing pin.

4. A method for rendering a firearm safe to dry fire comprising:

inserting in the firearm cartridge chamber a bushing in place of a cartridge; and inserting through said bushing a length of flexible material having a length which extends through said firearm barrel where a distal end is visible to an observer, and which has a second end extending rewardly from said bushing a distance to be struck by said firearm firing pin when said firearm hammer is released, said flexible material having a hardness which avoids damage to said firing pin and wherein on said distal end of said flexible material an indicator is included to indicate said firearm is safe to dry fire.

5. The method according to claim 4 including selecting a diameter and length for said bushing which permits said bushing to be used in a variety of firearms having a common caliber.

6. An article of manufacture which permits a firearm to be safely dry fired comprising:

a bushing having a diameter to be accepted in a chamber of a variety of firearms of a common caliber, said bushing having a bore for receiving a flexible material which extends from said bushing to the distal end of said barrel where it is visible as an indicator said firearm is safe to dry fire; said bushing having a length to permit a firing pin of said firearm to strike an exposed pliant material supported by said bushing and wherein said bushing includes a rim which establishes the spacing between said firing pin and said exposed pliant material.

7. The article of manufacture according to claim 6 wherein said exposed pliant material is one end of said length of flexible material.

8. The article of manufacture according to claim 7 wherein said flexible material is a cable tie which has at one end thereof a tie head serving as said pliant material.

9. The article of manufacture according to claim 6 where in said bushing includes a bore which has a portion of a first diameter which permits said exposed pliant material to be positioned in said bore, and a second portion of a second, smaller diameter for restraining said exposed pliant material from moving forward.

* * * * *